US005636646A

United States Patent [19]

Zito

[11] Patent Number: 5,636,646

[45] Date of Patent: Jun. 10, 1997

[54] FINE-TOOTH COMB FOR TREATING PEDICULOSIS

[75] Inventor: Alejandro M. Zito, Buenos Aires, Argentina

[73] Assignee: Chemotecnica Sintyal S.A., Capital Federal, Argentina

[21] Appl. No.: 680,638

[22] Filed: Jul. 16, 1996

[30] Foreign Application Priority Data

Jan. 16, 1996 [AR] Argentina ..... 00025

[51] Int. Cl.[6] ..... A45D 24/04

[52] U.S. Cl. ..... 132/149; 132/150; 132/152; 132/219

[58] Field of Search ..... 132/219, 125, 132/149, 150, 152, 153, 154; 119/625, 630, 632, 631, 633

[56] References Cited

U.S. PATENT DOCUMENTS

| | | | |
|---|---|---|---|
| 3,042,048 | 7/1962 | Mostik | 132/150 |
| 4,612,944 | 9/1986 | Bachrach et al. | 132/219 X |
| 4,671,303 | 6/1987 | Saferstein et al. | 132/152 |
| 5,131,418 | 7/1992 | Vaccaro | 132/152 X |
| 5,339,840 | 8/1994 | Koppel | 119/625 X |

*Primary Examiner*—Jeffrey A. Smith

*Attorney, Agent, or Firm*—Birch, Stewart, Kolasch & Birch, LLP

[57] ABSTRACT

A fine-tooth comb for treating pediculosis and in particular, for removing lice and lice eggs includes a removable piece and an elongated piece. The removable piece has a plurality of metallic teeth. The removable piece can be detachably mounted in a head of the elongated piece. A handle adjacent to the head can be gripped by a patient such that he or she can easily comb their hair in order to remove lice and lice eggs.

14 Claims, 1 Drawing Sheet

FINE-TOOTH COMB FOR TREATING PEDICULOSIS

BACKGROUND OF THE INVENTION

1. Field of the Invention

The present invention relates to a fine-tooth comb for treating pediculosis and in particular for removing lice and lice eggs.

2. Description of the Background Art

Pediculosis is a scalp infection which is produced by the Pediculus Humanus, Capitis variety. This is a parasite which feeds on blood. The parasite will bite the scalp thereby causing a wound which can go from a simple irritation to a serious infection with ganglionic inflammation. An adult parasite will deposit eggs which remain stuck to the hair during their incubation period. These eggs will ripen in about two to three weeks. The problem of pediculosis has worsen in recent years, particularly among school aged children. Great pains are required for its treatment.

To date, treatments have involved two steps. First, the adult lice are exterminated, and secondly, the eggs are removed from the hair. The first step is carried out with pediculicide chemical products. The second step of removing the eggs is indispensable to eradicate the infestation. If this step is omitted, the patient will believe he or she is cured by the use of a pediculicide agent. When the eggs which have not been removed from the patient's hair hatch in two or three weeks, they may think there are suffering a new infestation when, in fact, it is merely the birth of the remaining eggs.

The removal of lice eggs has typically been done by hand. This is a boring and unpleasant task for both the patient and the person in charge of it. Special fine-tooth combs have been developed for this task. These combs comprise a number of teeth with a minimum separation between each tooth. These combs will remove and retain the lice eggs when they are passed through the hair.

The available fine-tooth combs generally have short teeth and a small handle or holding portion. These features make it difficult for the patient to use the comb himself or herself, thereby necessitating the need for someone's help. Besides, the relatively short teeth only have a limited penetration for curly and/or full hair thereby making complete lice and lice egg removal an arduous operation.

SUMMARY OF THE INVENTION

Accordingly, it is an object of the present invention to provide a fine-tooth comb which will overcome the drawbacks of the prior art and will allow a patient to comb his or her hair, even when the patient has curly and/or full hair.

It is a further object of the present invention to provide a fine-tooth comb with removable teeth that can be easily sterilized.

These and other objects of the present invention are fulfilled by providing a fine-tooth comb for treating pediculosis and in particular for removing lice and lice eggs. The comb comprises a removable piece and an elongated piece. The removable piece has a plurality of metallic teeth. The elongated piece has a head and a handle. The head has means for receiving the removable piece. This means for receiving includes an opening formed in the head into which the removable piece is detachably removably mounted. The head has a length of about one-third of the elongated piece while the handle will be about two thirds of the length of the elongated piece. Therefore, the comb can be easily gripped and used by a patient.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
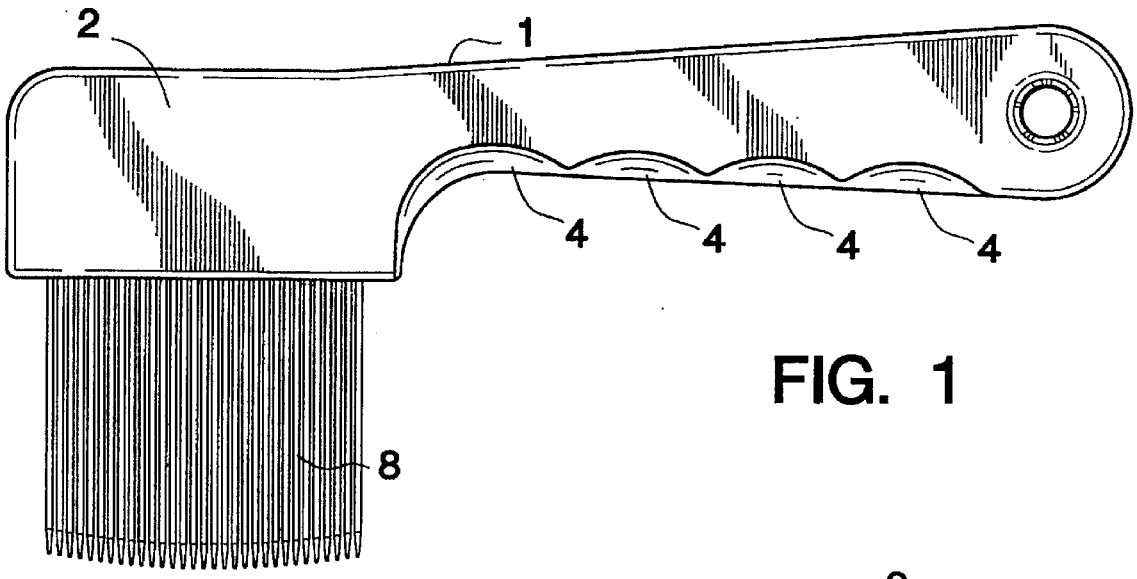
FIG. 1 is a side view of the fine-tooth comb of the present invention.

Referring in detail to the drawings and with particular reference to FIG. 1, a fine tooth-comb is shown. This comb comprises an elongated piece 1 made of a rigid polymeric material. The elongated piece 1 includes a head 2 and a long handle 3 which are of a rigid one-piece construction. Generally, the head is about one-third of the length of the elongated piece 1 while the remaining two-thirds of the elongated piece 1 are the handle 3. In particular, the head can be 5½ cm while the handle is 9 cm. Of course, the exact dimensions used can vary. It is merely necessary for the handle 3 to have a sufficient length so as to be easily held by a patient. Notches 4 are provided in the internal edge of the handle 3. These notches 4 will accommodate the user's fingers.

The head portion 2 is hollow having an opening 5 therein. This opening 5 has a generally rectangular shape as indicated in dotted lines in FIG. 2. As seen in FIG. 3, the hole 6 for opening 5 is shown. The hole 6 also has a rectangular shape.

Figure 2:
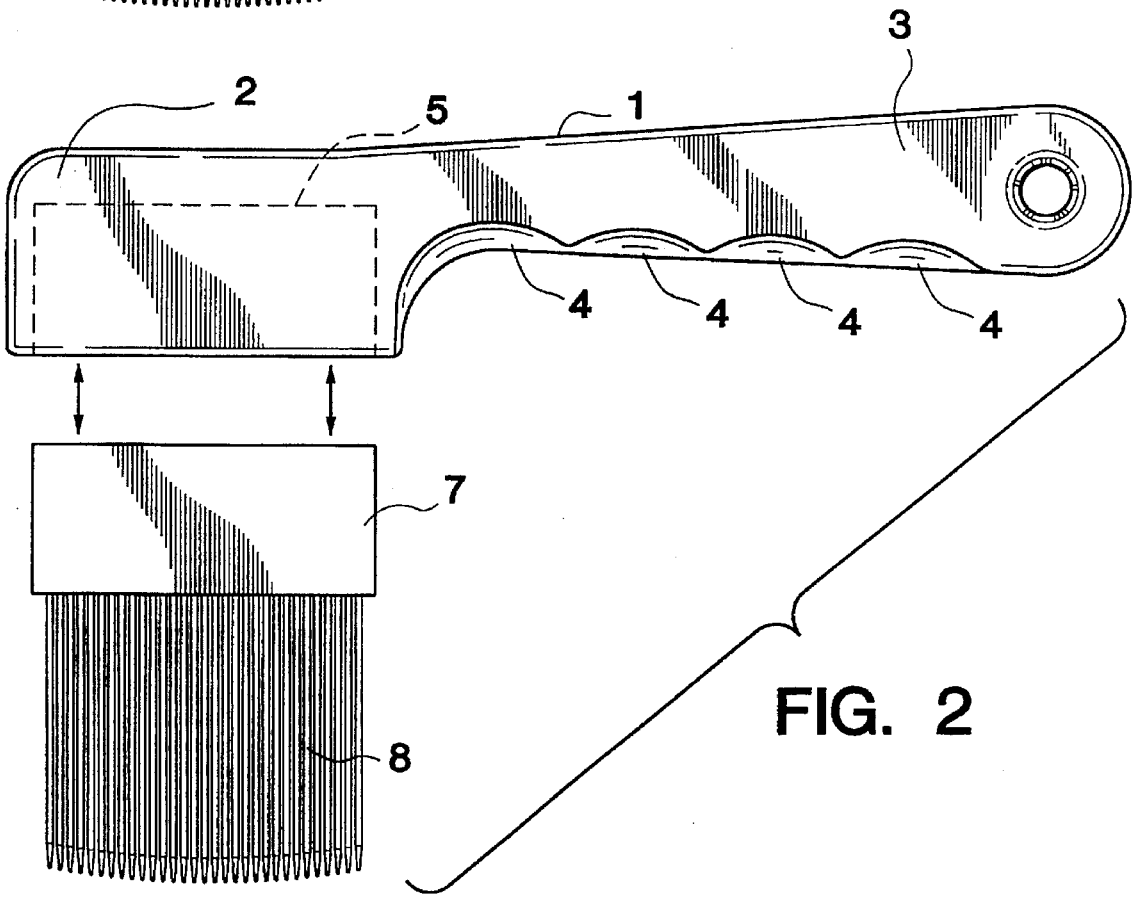
FIG. 2 is an exploded side view of the fine-tooth comb of the present invention with the removable piece detached from the head of the elongated piece.
Figure 3:
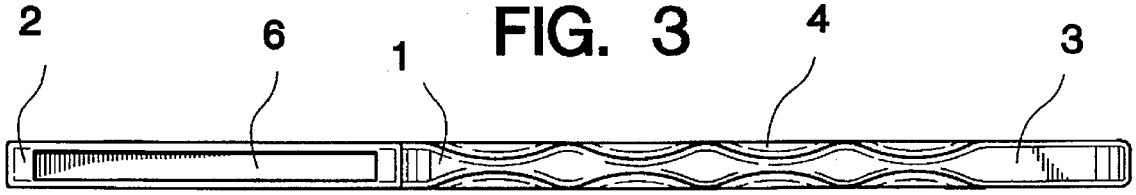
FIG. 3 is a bottom view of the fine-tooth comb of the present invention with the removable piece omitted.

In FIG. 2, the removable piece 7 is indicated. This removable piece 7 can be detachably mounted in the opening 5 as indicated in FIG. 1. The removable piece 7 can easily be pulled from and reinserted into the opening 5. A portion of piece 7 is inserted through hole 6 during this procedure. The substantially flat and rectangular removable piece 7 is snugly fit within the opening 5 such that it will be firmly held by friction in position when mounted therein. A single row of parallel wires or metallic teeth 8 are provided in the removable piece 7. It is contemplated that several teeth 8 will be used. In fact, more than thirty teeth can be used on the elongated piece 7 and in the disclosed embodiment thirty-one teeth are used. Because such a great number of teeth are used, the amount of brushing strokes required can be reduced. It is contemplated that the teeth 8 will be rigidly mounted in the removable piece 7.

Each of the teeth 8 is aligned in a single, linear row. Each tooth 8 has an elongated shaft portion and a tapered end portion. The teeth 8 are spaced closely together. They are spaced such that hair can pass therethrough while lice eggs and lice will be caught in the teeth of the comb 8.

As indicated in FIG. 2 and as noted above, the piece 7 is removable from the opening 5 in order to allow its cleaning or sterilization. The sterilization can be accomplished by immersing the removable piece 7 and teeth 8 in boiling water. The removable piece is made of a thermoresistant material. In other words, this piece 7 and the metal teeth 8 will not melt when immersed in boiling water. Of course, the removable piece 7 and teeth 8 can be made from any suitable material. In fact, these elements can be molded or otherwise formed from the same material such that they are an integral, one-piece construction.

The long handle 3 of the elongated piece 1 has a sufficient length in order to allow a patient to easily grasp it. The whole hand of the patient can grasp this long handle 3 thereby allowing sufficient force to be applied upon the head 2 when combing the patient's hair. In other words, there is great arm lever or force which can be applied in order to move the metallic teeth 8 through the patient's hair. Therefore, if the patient has curly or thick hair, the instant comb can readily remove lice and lice eggs. Preferably, the handle 3 of the instant invention is at least nine centimeters in length as noted above. The metallic teeth 8 of the comb of the present invention are at least three and a half centimeters in length and can be up to four centimeters in order to guarantee suitable hair penetration. Of course, the exact length of the teeth 8 can be varied as needed. It is contemplated that long teeth rather than conventional shorter teeth will be used to guarantee appropriate hair penetration. Also, the teeth are spaced sufficiently close together to effectively remove lice and lice eggs while yet permitting the hair to pass therethrough.

A through hole is provided at an end of handle 3 distance from the head 2. The comb can be hung or otherwise supported through this hole.

It is contemplated that the fine-tooth comb of the instant invention can be easily used by a patient. The need for someone other than the patient to comb the hair is obviated. The relatively long teeth of the instant comb will penetrate curly and/or full hair making the lice and lice egg removal task less arduous.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A fine-tooth comb for treating pediculosis comprising:

a removable piece having a plurality of metallic teeth; and an elongated piece having a head and handle, the head having means for receiving the removable piece, the means for receiving including an opening formed in the head into which the removable piece is detachably mounted, the head being about one third of a length of the elongated piece and the handle being about two-thirds of the length of the elongated piece.

2. The fine-tooth comb as claimed in claim 1, wherein the metallic teeth are each at least three and a half centimeters in length.

3. The fine-tooth comb as claimed in claim 1, wherein the handle is at least nine centimeters in length.

4. The fine-tooth comb as claimed in claim 3, wherein the head and handle are a rigid one-piece construction.

5. The fine-tooth comb as claimed in claim 1, wherein the elongated piece is made of rigid polymeric material.

6. The fine-tooth comb as claimed in claim 1, wherein the opening of the means for receiving is a rectangular opening which conforms to a shape of the removable piece which is insertable therein.

7. The fine-tooth comb as claimed in claim 1, wherein the removable piece is made of a thermoresistant material.

8. The fine-tooth comb as claimed in claim 1, further comprising notches provided along the handle, fingers of a user being accommodatable in the notches of the handle.

9. The fine-tooth comb as claimed in claim 1, further comprising a through-hole provided in an end of the handle distal from the head.

10. The fine-tooth comb as claimed in claim 1, wherein more than thirty teeth are provided in the removable piece, the teeth being aligned in a generally linear row and each tooth having an elongated shaft portion and a tapered end portion.

11. The fine-tooth comb as claimed in claim 1, wherein the elongated piece is made of rigid polymeric material, the opening of the means for receiving being a rectangular opening which conforms to a shape of the removable piece which is insertable therein.

12. The fine-tooth comb as claimed in claim 11, wherein the removable piece is made of a thermoresistant material and wherein the comb further comprises notches provided along the handle, fingers of a user being accommodatable in the notches of the handle.

13. The fine-tooth comb as claimed in claim 12, wherein the metallic teeth are each at least three and a half centimeters in length and wherein the handle is at least nine centimeters in length.

14. The fine-tooth comb as claimed in claim 13, wherein more than thirty teeth are provided in the removable piece, the teeth being aligned in a generally linear row and each tooth having an elongated shaft portion and a tapered end portion.

* * * * *